United States Patent [19]

Beach

[11] 4,162,011

[45] Jul. 24, 1979

[54] APPARATUS FOR SORTING FRUITS AND VEGETABLES

[75] Inventor: Richard L. Beach, Danville, Calif.

[73] Assignee: Hunt-Wesson Foods, Inc., Fullerton, Calif.

[21] Appl. No.: 733,397

[22] Filed: Oct. 18, 1976

[51] Int. Cl.[2] ..... B07C 5/00

[52] U.S. Cl. ..... 209/637; 209/695; 209/919; 209/936

[58] Field of Search ..... 209/114, 117, 637, 695, 209/919, 936

[56] References Cited

U.S. PATENT DOCUMENTS

| | | | |
|---|---|---|---|
| 325,093 | 8/1885 | King | 209/114 |
| 1,241,045 | 9/1917 | Stadtherr et al. | 209/114 |
| 3,886,951 | 6/1975 | McRobert | 209/114 |

*Primary Examiner*—Robert J. Spar
*Assistant Examiner*—H. Grant Skaggs
*Attorney, Agent, or Firm*—Dennison, Dennison, Meserole & Pollack

[57] ABSTRACT

Apparatus for sorting firm whole fruits and vegetables from those which are soft and broken by sliding or rolling the specimens to be sorted down an inclined plane to impart momentum and velocity and then dropping them on a rearwardly moving conveyer belt. The firm whole specimens will have achieved sufficient forward velocity on the inclined plane to overcome the rearward motion of the conveyer belt while the soft broken specimens will be carried rearwardly with the belt.

12 Claims, 2 Drawing Figures

APPARATUS FOR SORTING FRUITS AND VEGETABLES

The present invention relates to methods of apparatus for sorting a particular fruit or vegetable and more particularly, the sorting of a generally spherical fruit or vegetable in order to separate those of a whole and firm condition from those which are broken and soft.

While the separation of a fruit or vegetable into different grades of quality is important from the standpoint of selling and pricing, in the tomato processing and canning industry there exists another important reason for separating whole firm fruits from soft and broken ones. In processing tomatoes for canning, tomatoes utilized in a number of particular canned tomato produces are peeled prior to being canned, and an accepted process in the industry for peeling tomatoes is to immerse the tomatoes in a caustic solution which loosens the peel from the tomato to facilitate mechanical removal. The tomatoes are then thoroughly washed and cleaned and canned whole or in pieces of desired size. Although caustic or lye tomato peelers perform well on whole firm tomatoes, when a tomato which is broken, or which has a cracked skin is subjected to this type of peeling, the caustic solution enters the interior of the tomato destroying all or a sizeable portion of the meat of the tomato. Since tomatoes with broken skins can be utilized without having to be lye-peeled for other applications such as paste or ketchup, it is desirable to be able to remove broken tomatoes and those with cracked skins from a quantity of tomatoes designated for peeling.

While separation of tomatoes between those with whole skins and those with broken skins can be accomplished by manual inspection and sorting, the high cost of labor and slow rate of sorting makes such a hand-sort operation commercially impractical resulting in it actually having been more economical at times to destroy tomatoes with broken skins during lye peeling rather than to perform hand-sorting operations.

SUMMARY OF THE INVENTION

It is the general aim of the present invention to provide a new and improved apparatus and method for sorting generally round fruits and vegetables such as tomatoes so that those with broken skins or peels can be separated from those which are whole and firm. A related object of the invention is to provide an improved apparatus and method for sorting generally round fruits and vegetables which is faster and more economical than any which have heretofore been available.

It is another object of the invention to provide a relatively low cost sorting/separating apparatus which is simple in construction so that repair, adjustment and maintenance can be accomplished in a relatively short time.

Still a further object of the invention is to provide a sorting/separating apparatus which can be adjusted so as to be able to selectively vary the degree of separation of a fruit or vegetable so that varying input demands can be accomodated.

BRIEF DESCRIPTION OF THE DRAWINGS

Other objects and advantages of the invention will appear from the following description taken in conjunction with the accompanying drawings in which.

Figure 1:
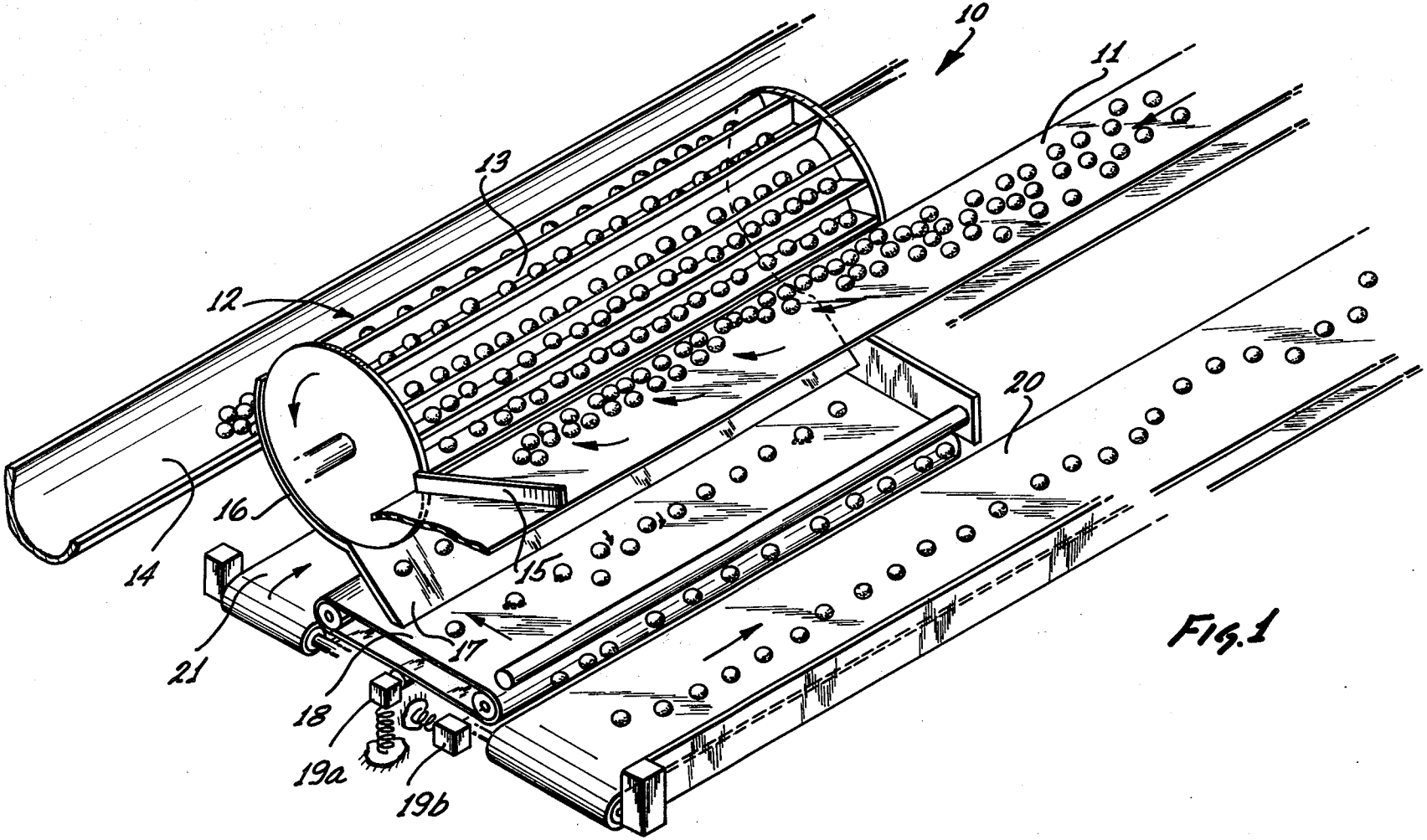
FIG. 1 is a perspective view of an exemplary sorting-/separating apparatus embodying the features of the present invention; and, FIG. 2 is a side elevation of the apparatus shown in FIG. 1.

While the present invention is susceptible of various modifications and alternative constructions, illustrative embodiments are shown in the drawings and will herein be described in detail. It should be understood, however, that it is not to be intended to limit the invention to the particular forms disclosed, but, on the contrary, the intention is to cover all modifications, equivalents, and alternative constructions falling within the spirit and scope of the invention as expressed in the appended claims.

DESCRIPTION OF THE PREFERRED EMBODIMENT

Figure 2:
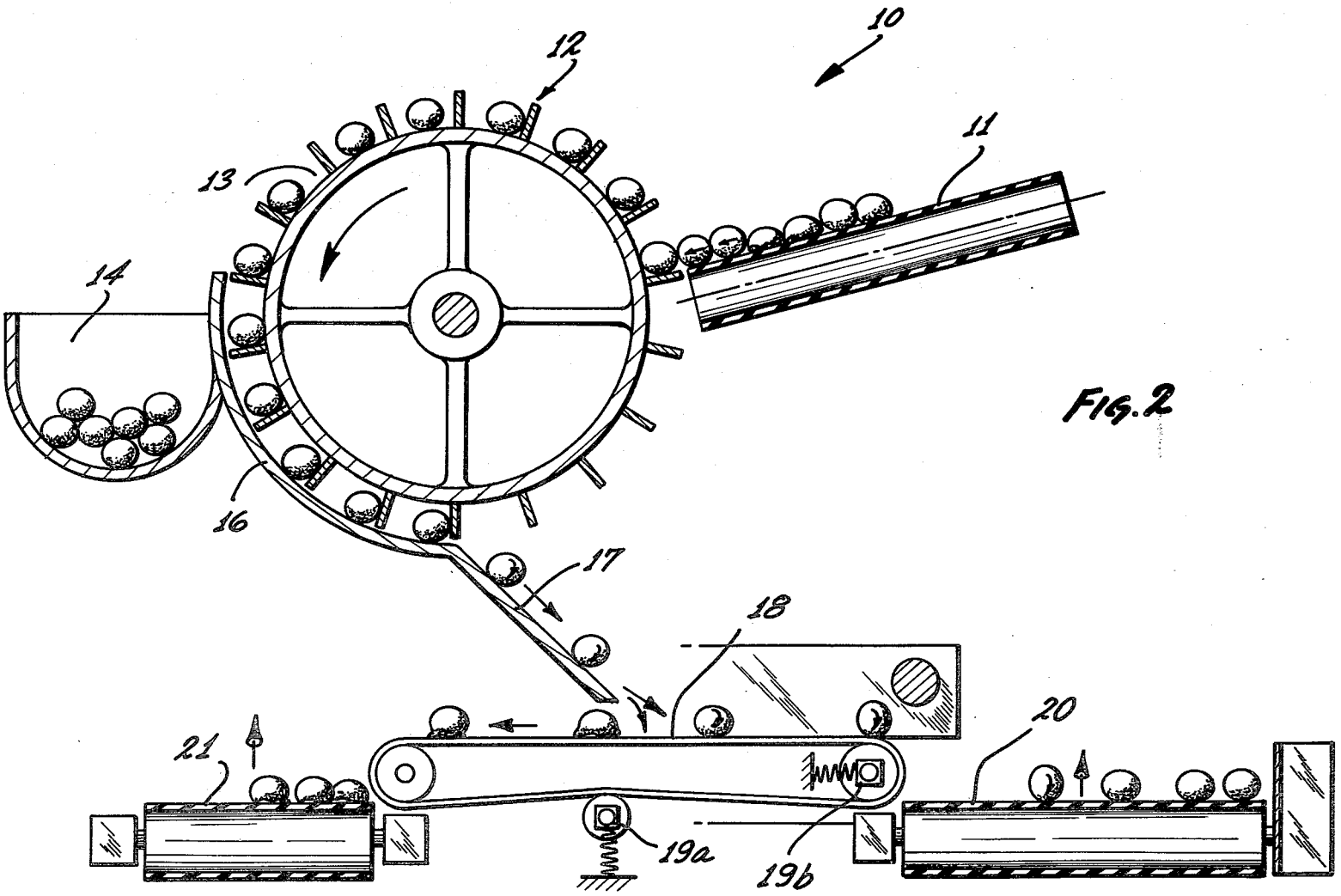

Referring now to FIGS. 1 and 2, an exemplary sorting/separating apparatus for use with tomatoes generally indicated at 10, is illustrated with a conveyor belt 11 supplying the apparatus with incoming tomatoes such as that which have just been hauled from the fields after being harvested.

In order to align and to further be able to make a rapid visual inspection of the incoming tomatoes prior to being mechanically separated along with being able to manually remove obviously damaged tomatoes and foreign objects, the incoming tomatoes are gravity transferred to a rotational sorting apparatus 12 which is provided with a plurality of successive longitudinal channels or flights 13 which in turn are sized to receive a separate row of tomatoes by virtue of the downward slant of the end of conveyer belt 11 (FIG. 2) and a stop 15 which is located to coincide with the furthermost ends of the flights 13. In order to carry away damaged tomatoes and foreign objects such as leaves and vines that are manually removed from the flights 13 of the rotational sorting apparatus 12, a water-conveying flume 14 is provided adjacent to the side of the rotational sorting apparatus opposite the conveyer belt 11.

In accordance with the aim of the present invention, provision is made for separating whole firm fruits or vegetables from those which are broken or have cracked skins. This is accomplished by utilizing rolling and rebound properties which are inherent in whole firm fruits or vegetables and which are absent from those with broken skins which tend to be soft and mushy. In the exemplary apparatus 10, the tomatoes in each flight 13 of the rotational sorting apparatus 12 are retained by a retention plate 16 as they are advanced to the lower portion of the sorting apparatus 12 and upon reaching a lowermost position they are simultaneously released from their respective flight 13 onto a means for imparting momentum comprising a downwardly directed inclined slide 17 upon which they roll or slide depending on their condition and then drop onto a taut separating belt 18 which is driven in a direction opposite to that of the horizontal velocity component of the tomatoes traveling down slide 17. As can be best seen by referring to FIG. 2, those tomatoes which are whole and firm develop sufficient horizontal velocity and momentum in rolling down the slide 17 that they overcome the opposite direction of movement of the transfer belt 18 and roll to the end of the transfer belt 18 and drop off onto a conveyer belt 20 which carries the whole tomatoes to a peeler. Those tomatoes which have a broken skin and are of a soft and mushy consistency are unable to develop sufficient velocity and momentum in coming down the slide to overcome the opposite horizontal movement of the transfer belt 18 and accordingly, once they drop onto the belt, they are carried in the direction of the transfer belt 18 to conveyer belt 21 which transports these tomatoes to a location where they can be utilized for applications not requiring lye peeling.

In accordance with another important aspect of the present invention, provision is made for being able to vary the respective proportion of separation so as to be able to adjust to factors such as the incoming supply of tomatoes, the cost of a particular crop and the amount of the particular tomato product designated for canning. This is accomplished by adjusting the speed of the transfer belt 18, and its tautness, which has been found to play and important role in how the tomatoes roll when they are dropped onto the belt 18. The degree of tautness of the transfer belt 18 is maintained by a means for adjusting the tension of the upper surface of the belt 18 which comprises tension adjusters 19*a* and 19*b*. Proper operation has been achieved when the belt 18 is maintained under sufficient tension so that the upper surface provides a trampoline effect i.e., resilient springboard, when the tomatoes drop onto it. In the illustrated embodiment, the slide 17 is of a length of about 12 inches and is set at an angle of about 45 degrees with the horizontal, although satisfactory results can be obtained when this angle is adjustably varied between 30 degrees and 45 degrees, such as by appropriately bending at the juncture of retention plate 16 and slide 17, and the speed of the belt 18 is varied between 10 feet/minute and 150 feet/minute.

In order to achieve the best sorting operation from the illustrated embodiment, the rotational sorting apparatus 12 is rotated at a speed which will allow one flight 13 of tomatoes to travel down the slide 17 and be cleared off the area of the belt 18 adjacent slide 17 before depositing another flight load onto the belt 18 since the subsequent tomatoes tend to interfere with the sorting of the previous row of tomatoes deposited on the belt 18.

I claim as my invention:

1. Apparatus for sorting generally spherical fruits and vegetables to separate firm whole specimens from soft broken specimens comprising:

means for imparting simultaneous downward and forward movement and momentum to a specimen to be sorted whereby the specimen achieves a substantially predetermined velocity and momentum which is substantially greater when a specimen is firm and whole than when it is soft and broken;

a generally horizontal rearwardly moving conveyor means having a resilient surface of a predetermined length to its forward end and which moves at a predetermined linear velocity, disposed beneath said imparting means;

means for tensioning said surface to impart a trampoline effect to a whole firm specimen with such velocity and momentum imparted thereto wherein when it is dropped onto said surface it will overcome the rearward motion of said surface and travel in a forward direction to said forward end of said surface and when a broken or soft specimen with said velocity imparted thereto is dropped onto said surface, it will be carried rearward to the rearward end of said surface;

said means for imparting movement depositing specimens on said moving conveyor at a point intermediate the forward and rearward ends of said resilient surface;

said means for imparting movement being structured to deposit generally simultaneously a plurality of specimens to be sorted onto said moving conveyor wherein specimens being sorted are cleared off the area of the moving conveyor underlying a point of deposit of specimens before an additional plurality of specimens is deposited on said moving conveyor; and means for separately collecting the sorted specimens.

2. The apparatus as set forth in claim 1 wherein said means for imparting simultaneous downward and forward movement and momentum comprises a downwardly directed inclined slide.

3. The apparatus as set forth in claim 2 wherein the angle of inclination of said slide is substantially 45 degrees.

4. The apparatus as set forth in claim 2 wherein the angle of inclination of said slide is substantially 30 degrees.

5. The apparatus as set forth in claim 2 wherein the angle of inclination of said slide is substantially 40 degrees.

6. The apparatus as set forth in claim 2 wherein the angle of inclination of said slide is substantially 35 degrees.

7. The apparatus as set forth in claim 2 wherein said conveyor means comprises an endless belt having an upper surface, and said means for tensioning said surface adjusts the tension of the upper surface of said endless belt.

8. The apparatus as set forth in claim 7 wherein the linear velocity of said endless belt can be adjusted between substantially 10 and 150 feed per minute.

9. The apparatus as set forth in claim 2 wherein said slide is substantially 12 inches in length and its angle of inclination is adjustable between substantially 30 degrees and 45 degrees.

10. Apparatus for sorting firm whole specimens of fruit and vegetables from soft broken specimens comprising:

means for amplifying rolling momentum and velocity of specimens to be sorted;

generally horizontal conveyor means having a resilient surface for receiving specimens to which amplified rolling momentum and velocity is imparted;

said means for amplifying rolling momentum and velocity of specimens being structured to deposit generally simultaneously a plurality of specimens to be sorted onto said resilient surface wherein specimens being sorted are cleared off the area of the resilient surface underlying a point of deposit of specimens before an additional plurality of specimens is deposited on said moving conveyor;

said resilient surface imparting a trampoline effect to firm specimens transported by said conveyor means;

said trampoline effect imparted enabling sorting of firm whole specimens from soft broken specimens; and, means for separately collecting the sorted specimens.

11. Apparatus for sorting generally spherical fruits and vegetables to separate firm whole specimens from soft broken specimens comprising:

means for imparting simultaneous downward and forward movement and momentum to a specimen to be sorted whereby the specimen achieves a substantially predetermined velocity and momentum which is substantially greater when a specimen is firm and whole than when it is soft and broken;

a generally horizontal rearwardly moving conveyor means having a resilient surface of a predetermined length to its forward end and which moves at a predetermined linear velocity, dispoed beneath said imparting means;

means for tensioning said surface to impart a trampoline effect to a whole firm specimen with such velocity and momentum imparted thereto wherein when it is dropped onto said surface it will overcome the rearward motion of said surface and travel in a forward direction to said forward end of said surface and when a broken or soft specimen with said velocity imparted thereto is dropped onto said surface, it will be carried rearward to the rearward end of said surface;

means for separately collecting the sorted specimens;

said means for imparting simultaneous downward and forward movement and momentum comprising a downwardly directed inclined slide;

said conveyor means comprising an endless belt having an upper surface; and wherein said means for tensioning said surface adjusts the tension of the upper surface of said endless belt.

12. The apparatus as set forth in claim 11 wherein the linear velocity of said endless belt can be adjusted between substantially 10 and 150 feet per minute.

* * * * *